US005324125A

United States Patent [19]

Ackermann

[11] Patent Number: 5,324,125

[45] Date of Patent: Jun. 28, 1994

[54] COSMETIC APPLIER COMPRISING A CONTAINER ASSEMBLY AND AN INSERTABLE POMADE CUP ASSEMBLY

[75] Inventor: Walter T. Ackermann, Watertown, Conn.

[73] Assignee: Risdon Corporation, Naugatuck, Conn.

[21] Appl. No.: 974,292

[22] Filed: Nov. 10, 1992

[51] Int. Cl.[5] ..... A45D 40/06

[52] U.S. Cl. ..... 401/78; 401/86; 401/98

[58] Field of Search ..... 401/98, 86, 87, 78; 206/385

[56] References Cited

U.S. PATENT DOCUMENTS

| | | | |
|---|---|---|---|
| 2,753,991 | 7/1956 | Sherman | 401/98 X |
| 2,921,675 | 1/1960 | Clark et al. | 401/78 |
| 3,230,960 | 1/1966 | Moore et al. | 401/98 X |
| 3,706,354 | 12/1972 | Gruska | 401/78 |
| 3,806,263 | 4/1974 | Webster | 401/78 |

FOREIGN PATENT DOCUMENTS

| | | | |
|---|---|---|---|
| 146404 | 5/1952 | Australia | 401/98 |
| 1205370 | 2/1960 | France | 401/98 |
| 687064 | 2/1953 | United Kingdom | 401/87 |

*Primary Examiner*—Steven A. Bratlie
*Attorney, Agent, or Firm*—Dallett Hoopes

[57] ABSTRACT

A cosmetic applier comprises a container assembly including a tubular sleeve, a cup holder reciprocable inside the sleeve and a cam for raising and retracting the cup holder. A pomade cup assembly includes a cup carrying pomade and an inverted cup-shaped transparent shroud about the pomade and connected to the top of the cup, the shroud having a diameter at least as great as the inner diamater of the sleeve. Interfitting fastener parts are on the cup and holder. In the preferred version, the fastener is of the permanently locking type. The selected pomade cup may be snapped into the holder and the holder and cup retracted by turning the cam so that the shroud, engaging the sleeve and spread by it, pops off the cup and is freed for easy disposal.

3 Claims, 2 Drawing Sheets

COSMETIC APPLIER COMPRISING A CONTAINER ASSEMBLY AND AN INSERTABLE POMADE CUP ASSEMBLY

BACKGROUND OF THE INVENTION

1. Field of the Invention

This invention relates to a cosmetic applier having an insertable pomade cup assembly. More specifically, the invention relates to a lipstick applier in which the container assembly comprising the usual tubular sleeve, its cup holder and the surrounding cam may be marketed and selected separately from the cup assembly comprising the pomade, its cup and a transparent tubular shroud protecting the pomade and connected to the cup. The selected container assembly and pomade cup assembly may be united by the retailer or the purchaser.

2. Description of Related Art including Information Disclosed under §§1.97 to 1.99

The prior art includes a number of patents wherein a pomade cup assembly may be installed into its lipstick container after purchase. The purpose has usually been to permit the replacement of an old used-up pomade without having to buy an entirely new lipstick container. Such an arrangement can also permit selective replacement of one color pomade for another so that the user can choose a color most suitable with the outfit she wears on a given evening.

More specifically, the prior art includes a number of patents to Claudine Sherman. In her U.S. Pat. No. 2,678,128 she provides a cup in which the pomade is molded, a transparent housing which fits over the cup and pomade, and a cap which fits over the assembly over the bottom. In use, the cap is removed and the cup is inserted into the cup holder of the lipstick container. The transparent housing is then pulled away, exposing the lipstick.

Other Sherman U.S. Pat. Nos. 2,753,991 issued Jul. 10, 1956 and U.S. Pat. No. 2,767,834 issued Oct. 23, 1956 show similar arrangements. In each the pomade cup is pressed into a holder in the lipstick container. In U.S. Pat. No. 2,753,991 a crossbar is provided in the holder and a slot in the bottom of the pomade cup wedges over the bar when the cup assembly is inserted.

U.S. Pat. No. 2,629,489 which issued Feb. 24, 1953 to de Shelly provides a refill cartridge wherein a circumferential band grips the transparent housing and cup.

The U.S. Pat. No. 2,497,950 to Lohr et al issued Feb. 21, 1950 shows a changable lipstick including several pomade-filled cups sold together with a container. The cups have ridges on them and are pushed into a holder in the lipstick container for use and then later pulled out by means of a special apparatus so that other colored pomades may be substituted.

In the Moore et al U.S. Pat. No. 3,230,960 which issued Jan. 25, 1966, a container assembly is provided including a sleeve, cup holder and screw-threaded cam, the cup holder having a head which is releaseably engaged by a socket on the bottom of the pomade cup. A plastic adapter may enclose a replacement pomade and cup, the adapter fitting over the top of the container sleeve which it frictionally engages. In use, with the cup extended, the old cup is exposed above the sleeve and may be snapped out of its head-socket connection in the holder. Subsequently, with the new pomade cup connected, the holder is retracted, and the pomade is withdrawn from the adapter. The empty adapter may be removed from the container sleeve and disposed of.

SUMMARY OF THE INVENTION

The purpose of the present invention is not to provide a new arrangement for lipstick refills or substitution of one colored pomade for another. This is deemed to be unsanitary because all pomades touch and contaminate the inside of the sleeve and cover. The aim of the invention is to provide a new system wherein the lipstick container assembly—that is, the sleeve, cam and cup holder—is sold separately from the pomade cup assembly and the two are combined to make a new permanent unit. This enables the purchaser to select the container she wants and the color pomade she wants as seen through the transparent shroud of the pomade cup assembly. She may either purchase these two units in their separate blister packs at a local mass merchandiser, unpackage them and put them together herself permanently, or she may purchase them separately at a fine department store where the clerk will assemble the units permanently together and present them to her in a fancy box.

The savings in cost and energy in this new system is clear. The system eliminates the need to inventory a container enclosing each unit of pomade as has heretofore been necessary. Containers are relatively expensive. Under the invention, retailers and fillers will not have to buy as many containers as they have before.

The invention, therefore, is a cosmetic applier including a container assembly which comprises a tubular sleeve, a cup holder reciprocable inside the sleeve and means for raising the cup holder, and a pomade cup assembly. The latter includes a cup carrying pomade and an inverted cup-shaped transparent shroud about the pomade and having interfitting engagement with the top of the cup, the shroud having an outer diameter at least as great as the inner diamater of the sleeve. The cup and cup holder have mating fastener parts.

By virtue of the structure described, the selected pomade cup may be connected into the holder and the cup and holder retracted so that the shroud forcefully engages the sleeve and is disengaged from its interfitting engagement with the cup and is thereby automatically freed for easy disposal.

In a preferred version, the top of the sleeve is tapered to fit inside the bottom of the shroud so that the shroud is wedged open as the pomade cup assembly is retracted, causing the disengagement. Also, the mating fastener parts are of the permanently locking type.

BRIEF DESCRIPTION OF THE DRAWINGS

Further objects and features of the invention will be apparent from the following specification and the drawings, all of which disclose a non-limiting embodiment of the invention. In the drawings.

DESCRIPTION OF THE PREFERRED EMBODIMENT

Figure 1:
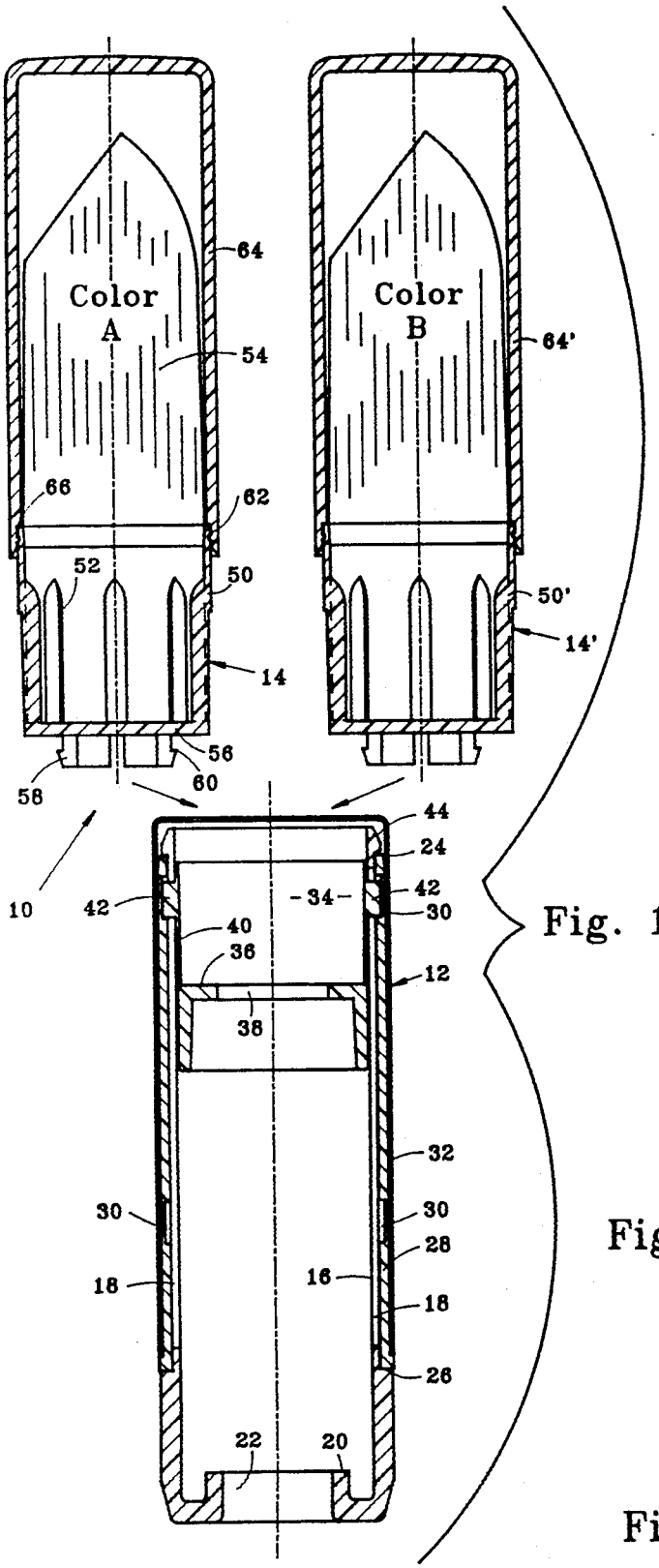
FIG. 1 is an exploded view showing in centerline sections the container assembly and a pair of pomade cup assemblies, either of which may be selectively installed in the container assembly. The pomade is shown in outline.

A cosmetic applier embodying the invention is shown in FIG. 1 and generally designated 10. It comprises a container assembly 12 and a pomade cup assembly 14 or 14'. Cup assemblies 14 and 14' are identical except the color of the pomade is different in the two units so that the user can select her color and insert in the container assembly as indicated by the two arrows.

The container assembly comprises a sleeve 16 which is preferably of plastic and is formed with longitudinal slots 18 diametrically opposed as is conventional. The lower end of the sleeve is thickened and formed with a return 20 and a central opening 22. A central portion of the outside of the sleeve 16 is reduced to provide shoulders 24 and 26. Between these shoulders a tubular cam 28 is rotatable. On the inside of the cam 28 are formed steeply pitched spiral openings 30. A decorative metal shell 32 frictionally embraces the outside of the cam.

A cup holder 34 is provided which has a transverse floor 36 in which is a central opening or socket 38. A thin cylindrical wall 40 extends upward from the floor 36 and carries diametically opposed outward lugs 42 which extend through the slot 18 in the sleeve and into the spiral openings 30 respectively. As shown, the upper end of the sleeve 16 is beveled or tapered inwardly as at 44. The sleeve 16, cup holder 34 and cam 28 are preferably molded plastic.

The structure thus far described is comparable to a conventional lipstick container except that the cup holder 34 is not intended or designed to directly carry the pomade. As a result of the structure shown, when the lower end of the sleeve 16 is turned relative to the shell 32, the holder 34 keyed for rotation with the sleeve 16 by the lugs 42 will move up or down.

Figure 5:
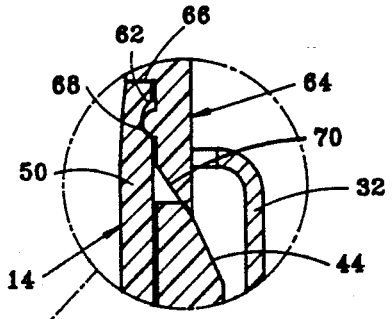
FIG. 5 is a greatly enlarged portion of FIG. 4 showing the interaction between the sleeve and the shroud.

Except for color of the pomade, the pomade cup assemblies 14 and 14' as stated are identical. They each comprise a plastic molded cup 50 or 50' dimensioned to fit into the holder 34. Uniformly spaced about the inside of the cup 50 are longitudinal ribs 52 to assist in gripping the pomade 54. The bottom of the cup 14 is formed with a floor 56 in the center of which is formed a radially slotted snap fastener head 58. Preferably, the head 58 is formed with flat undercut shoulder 60 to comprise a locking snap fastener element. About its upper end the cup 50 is formed with a peripheral groove 62 (FIG. 5).

The cup assembly is additionally comprised of an inverted cup-shaped transparent protective shroud 64, preferably of molded plastic, which is disposed over and about the pomade 54. The shroud is reduced on the inside of its lower end to present a shoulder 66 which butts against the top of the side wall of cup 50. Below the shoulder 66 the shroud is formed with an inward annular rib 68 (FIG. 5). In assembly, the transparent shroud 64 is brought down over the pomade and the inside of the lower end of the shroud is provided with a tapered section 70 which affords a lead-in for the top of the cup 14. The shroud 64 expands somewhat and the rib 68 rides over the top of the cup 14 and snaps into the groove 62. The extreme lower edge of the shroud is, because of the taper 70, spaced outward from the cup 50 (FIG. 5).

The pomade cup assembly 14 or 14' as described is sold as an individual unit and bought depending on the color desired by the purchaser from viewing the assembly end through the transparent bubble of a bubble pack or from a bank of different colored pomade assemblies at the counter of a department store.

Also purchased at the same time is the container assembly 12 which may be extensively ornamented on the outside of the shell 32 or may be rather plain. In each case the conventional container cover (not shown) is provided with the container assembly.

Once the purchaser selects the desired pomade cup assembly 14 or 14' and the container assembly 12, the bottom of the cup assembly 14 is inserted in the cup holder 34 through the opening in the top of the shell 32. The snap fastener head 58 enters the socket 38 in the floor 36 of the cup holder and upon being pushed forcefully down, the head segments, tapered on their outsides flex inwardly so that when the shoulder 60 reaches the level of the bottom of the socket 38, the segments snap outward and the cup assembly and the container assembly are locked together forever by this locking snap fastener.

A one-way or permanently locking plastic snap fastener is, of course, not new per se. Such products have been used in hospital bracelets and are disclosed in U.S. Pat. No. 3,210,820 which issued Oct. 12, 1965 to Humiston and U.S. Pat. No. 3,416,200 which issued Dec. 17, 1968 to Daddona.

Figure 2:
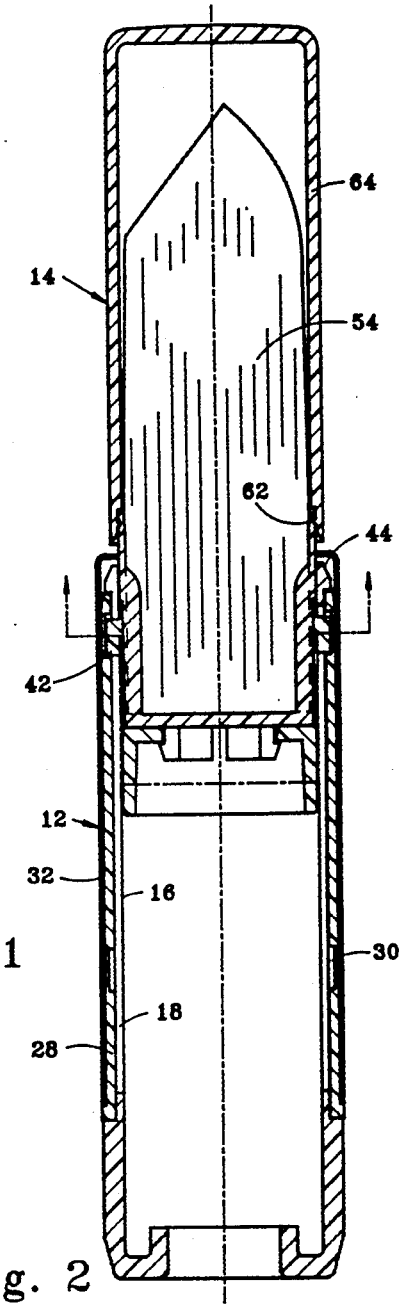
FIG. 2 is a centerline section of a pomade cup assembly and a container subassembly snapped together.
Figure 3:
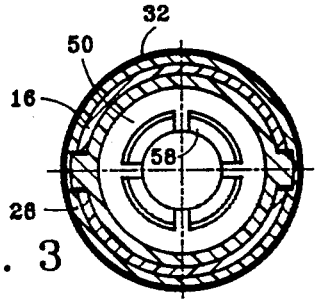
FIG. 3 is a sectional view taken on the line 3—3 of FIG. 2.
Figure 4:
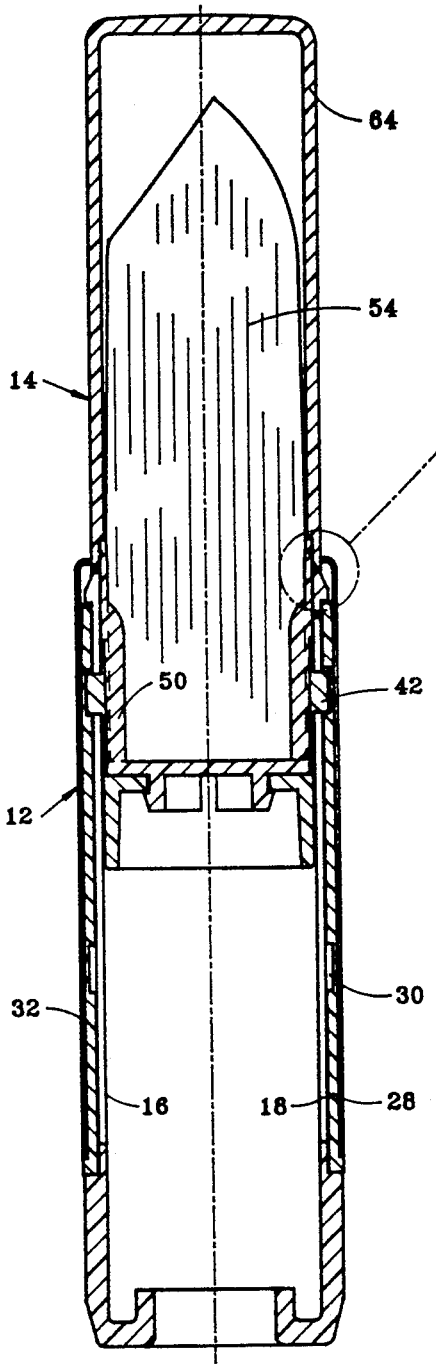
FIG. 4 is a centerline sectional view showing the structure of FIG. 2 with the cup partly retracted.

The structure is now as represented in FIG. 2 and only the removal of the shroud 64 remains to be done. It should be noted that the interference between the rib 68 and the groove 62 may be a matter of only four or five thousands of an inch in diameter. Even so, the shroud is virtually unremovable from the cup 50 by hand. A user could not buy merely the cup assembly 14 and use it by taking off the shroud and replacing it after use. It is not a friction fit. The secret to removal lies in using the mechanical advantage of the spiral cam 28 to draw the cup assembly downward.

As shown in FIG. 5, as the downward movement commences, the outward taper 70 on the shroud engages the inward taper 44 on the top of the sleeve. The sleeve is thick enough at this point to be relatively rigid so that it does not move inward to squeeze the cup 50 which might damage the pomade. Instead, the wall of the shroud 64, particularly adjacent its lower end because of the reduction at shoulder 66, is relatively yielding and the interaction of shroud 64 and sleeve 16 wedges the bottom of the shroud open. Longitudinal slotting of the bottom of the shroud is contemplated. Continued movement downward of the cup assembly 14 causes the groove 62 to move downward out of line with the rib 68. When the top of the cup side wall 50 passes the rib 68, the rib 68 moves inward and the shroud is free from the cup. The entire structure may then be inverted and the shroud will fall off for disposal. No grasping of the shroud or further manipulation of parts is necessary.

The pomade may be fully retracted in the container in the conventional way (FIG. 6) and the cover (not shown) may be slipped over the outside of the container.

Figure 6:
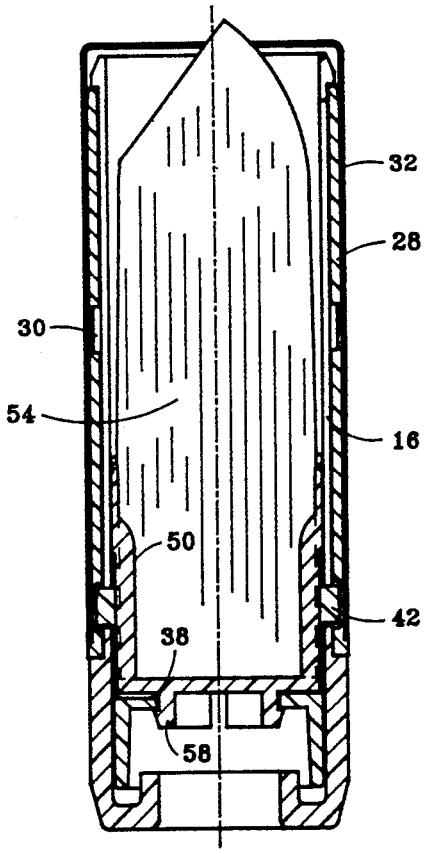
FIG. 6 is a centerline section of the applier with the holder fully retracted and the pomade cup assembly fully installed.

The completed applier, as shown in FIG. 6, is permanently assembled and because of the permanently locking snap fastener 38, 58 the pomade cup assembly cannot fall out of the container assembly. The permanent locking snap fastener arrangement has a virtue aside from those discussed. If a non-permanent-locking fastener were used, there would be risk of disengagement of the fastener parts 38, 58 when the holder 34 is drawn down during the first retraction. As a result, the retraction would fail to remove the shroud 54 and the cup assembly would sit on top of the sleeve unconnected to the holder 34.

An important feature of the structure described is, of course, the easy removal of the protective shroud 64 by merely drawing down the cup holder 34 using the mechanical advantage of the spiral cam. Removal of the shroud otherwise by hand is virtually impossible and, hence, the present arrangement is effective at protecting the pomade from curious shoppers.

Moreover, if one were to try to remove the shroud with tools, he would destroy the connection between shroud and cup so that even if he replaced the shroud, the damaging of the rib and groove 62, 68 would be evident.

It should be noted that unlike replaceable pomade cup assemblies of the prior art, no manipulation of the parts other than the simple screwing down of the pomade is necessary for stripping off the shroud 64. By virtue of the fact that it is not necessary to touch the shroud with the hand—the shroud pops off the cup and then one inverts the unit and the shroud falls off into the waste bin—one does not damage the pomade with one's hands.

The invention having been disclosed in only one of its embodiments is not limited to the embodiment shown but, instead, may take the form of variations not disclosed here. The invention, therefore, should be thought of as having the scope of the following language extended by any broadening of the right to exclude deemed appropriate under the Doctrine of Equivalents.

What is claimed is:

1. A cosmetic applier comprising:

a. a container assembly including:

1) a tubular sleeve having at its upper end an inwardly tapered edge about the periphery thereof, 2) a cup-shaped cup holder reciprocable between upward and downward positions inside the tubular sleeve and having a floor with a first one-way snap fastener part and an upward cylindrical side wall extending upward from the floor, 3) means for raising and lowering the cup holder inside the sleeve, b. a cup assembly comprising:

1) a pomade-containing cup having a floor with a mating one-way snap fastener part, the cup fitting into the cup holder with the first one-way snap fastener part engaged to the mating fastener part, the one-way snap fastener comprising a resilient head having an undercut neck with a radial locking surface and a socket having an opening with a flat locking surface against which the radial locking surface of the head lockingly abuts in a permanent connection, 2) an inverted cup-shaped transparent protective shroud disposed over and about the pomade and having a downwardly facing mouth fitting over and engaging the top periphery of the cup, the bottom of the shroud having an outwardly tapered edge about the inner periphery thereof and an outer diameter at least as great as the inner diameter of the sleeve, the top of the cup and the bottom of the shroud having interfitting means holding them releaseably together, whereby with the cup holder in upward position and the cup assembly in the holder and the one-way snap fastener parts interengaged, the holder may be retracted downward and the outwardly tapered bottom of the shroud will forceably engage over the inwardly tapered edge at the top of the sleeve and, as retraction continues, the bottom of the shroud will be widened to disengage the interfitting means and the shroud will be freed from the cup.

2. A cosmetic applier as claimed in claim 1 wherein the interfitting means comprise the cup having a groove about its outer surface and the shroud having a rib about its inner surface.

3. A cosmetic applier as claimed in claim 1 wherein the means for raising and lowering the cup holder comprises an outward lug in the holder, a longitudinal slot in the sleeve receiving the lug to key the cup for rotation with the sleeve and a tubular cam element circumposing the sleeve and having an inwardly accessible spiral opening about its inner surface, the lug extending into the spiral opening.

* * * * *